US009722323B2

(12) United States Patent
Yona et al.

(10) Patent No.: US 9,722,323 B2
(45) Date of Patent: Aug. 1, 2017

(54) ISOLATION STRUCTURES FOR DUAL-POLARIZED ANTENNAS

(71) Applicant: GALTRONICS CORPORATION LTD., Tiberias (IL)

(72) Inventors: Haim Yona, Givat Avni (IL); Shay Mamo, Tiberias (IL); Snir Azulay, Tiberias (IL); Yaniv Ziv, Tiberias (IL); Ruvim Goldman, Nazareth Illit (IL)

(73) Assignee: GALTRONICS CORPORATION LTD., Tempe, AZ (US)

( * ) Notice: Subject to any disclaimer, the term of this patent is extended or adjusted under 35 U.S.C. 154(b) by 199 days.

(21) Appl. No.: 14/387,573

(22) PCT Filed: Mar. 24, 2013

(86) PCT No.: PCT/IL2013/050295
§ 371 (c)(1),
(2) Date: Sep. 24, 2014

(87) PCT Pub. No.: WO2013/144965
PCT Pub. Date: Oct. 3, 2013

(65) Prior Publication Data

US 2015/0138032 A1 May 21, 2015

Related U.S. Application Data

(60) Provisional application No. 61/615,395, filed on Mar. 26, 2012.

(51) Int. Cl.
*H01Q 21/00* (2006.01)
*H01Q 21/24* (2006.01)
(Continued)

(52) U.S. Cl.
CPC ..... *H01Q 21/24* (2013.01); *H01Q 1/521* (2013.01); *H01Q 9/285* (2013.01);
(Continued)

(58) Field of Classification Search
CPC ..... H01Q 1/246; H01Q 21/24; H01Q 21/26
(Continued)

(56) References Cited

U.S. PATENT DOCUMENTS 3,541,559 A 11/1970 Evans
3,750,185 A 7/1973 Evans
(Continued)

FOREIGN PATENT DOCUMENTS

WO 2013/144965 10/2013

OTHER PUBLICATIONS

U.S. Appl. No. 61/615,395, filed Mar. 26, 2012.
(Continued)

*Primary Examiner* — Graham Smith
*Assistant Examiner* — Jae Kim
(74) *Attorney, Agent, or Firm* — Lorenz & Kopf, LLP.

(57) ABSTRACT

An antenna, including a first dipole having a first polarization, the first dipole including a first pair of dipole arms, a second dipole having a second polarization, the second dipole including a second pair of dipole arms, at least one dipole arm of the first pair of dipole arms being located with respect to at least one dipole arm of the second pair of dipole arms so as to form at least one isolation slot therebetween, currents along the at least one isolation slot being operative to at least partially cancel mutual coupling between the first dipole and the second dipole, and a feed arrangement for feeding the first and second dipoles.

12 Claims, 7 Drawing Sheets

(51) Int. Cl.

| | |
|---|---|
| ***H01Q 1/52*** | (2006.01) |
| ***H01Q 9/28*** | (2006.01) |
| ***H01Q 21/06*** | (2006.01) |
| ***H01Q 21/26*** | (2006.01) |

(52) U.S. Cl.
CPC ..... *H01Q 21/062* (2013.01); *H01Q 21/065* (2013.01); *H01Q 21/26* (2013.01)

(58) Field of Classification Search
USPC ..... 343/816, 797
See application file for complete search history.

(56) References Cited

U.S. PATENT DOCUMENTS

| | | | | |
|---|---|---|---|---|
| 4,131,896 | A | 12/1978 | Miller | |
| 5,039,994 | A | 8/1991 | Wash et al. | |
| 5,929,820 | A * | 7/1999 | Caulfield | H01Q 3/20 343/797 |
| 6,028,563 | A * | 2/2000 | Higgins | H01Q 1/246 343/797 |
| 6,069,590 | A | 5/2000 | Thompson et al. | |
| 7,132,995 | B2 | 11/2006 | Gottl | |
| 7,616,168 | B2 | 11/2009 | Tillery | |
| 7,688,271 | B2 * | 3/2010 | Cao | H01Q 9/28 343/797 |
| 7,692,601 | B2 | 4/2010 | Bisiules et al. | |
| 2007/0241983 | A1 | 10/2007 | Cao et al. | |

OTHER PUBLICATIONS

An International Preliminary Report on Patentability dated Oct. 1, 2014, which issued during the prosecution of Applicant's PCT/IL2013/050295.

An International Search Report and Written Opinion both dated Jul. 10, 2013, which issued during the prosecution of Applicant's PCT/IL2013/050295.

State Intellectual Property Office of the People's Republic of China, Office Action in Chinese Patent Application No. 201380016756.9 mailed Jan. 20, 2016.

* cited by examiner

ISOLATION STRUCTURES FOR DUAL-POLARIZED ANTENNAS

REFERENCE TO RELATED APPLICATIONS

Reference is hereby made to U.S. Provisional Patent Application No. 61/615,395, entitled ISOLATION IMPROVEMENT ELEMENTS FOR DIPOLES IN A BROADAND ARRAY, filed Mar. 26, 2012, the disclosure of which is hereby incorporated by reference and priority of which is hereby claimed pursuant to 37 CFR 1.78(a)(4) and (5)(i).

FIELD OF THE INVENTION

The present invention relates generally to antennas and more particularly to dual-polarized antennas.

BACKGROUND OF THE INVENTION

Various types of dual-polarized antennas are known in the art.

SUMMARY OF THE INVENTION

The present invention seeks to provide an improved dual-polarized dipole antenna and an isolation element particularly useful for inclusion therein.

There is thus provided in accordance with a preferred embodiment of the present invention an antenna, including a first dipole having a first polarization, the first dipole including a first pair of dipole arms, a second dipole having a second polarization, the second dipole including a second pair of dipole arms, at least one dipole arm of the first pair of dipole arms being located with respect to at least one dipole arm of the second pair of dipole arms so as to form at least one isolation slot therebetween, currents along the at least one isolation slot being operative to at least partially cancel mutual coupling between the first dipole and the second dipole, and a feed arrangement for feeding the first and second dipoles.

Preferably, the feed arrangement includes at least one feedline and at least one balun.

In accordance with a preferred embodiment of the present invention, the antenna also includes a stem operative to support the first and second dipoles, the feed arrangement being integrally formed with the stem.

Preferably, the antenna also includes an isolation element, the isolation element being inserted between a plurality of grooves formed on the stem.

Preferably, the isolation element is galvanically connected to the stem and not galvanically connected to the feed arrangement and to the first and second dipoles.

Preferably, the isolation element includes a conductive strip.

Preferably, the conductive strip has a dimension of the order of $\lambda/4$, where $\lambda$ is an operating wavelength of the antenna.

In accordance with a further preferred embodiment of the present invention, the conductive strip includes two recessed portions adapted for slotting into the plurality of grooves, each one of the recessed portions including a bent extrusion extending inwards from an edge thereof and adapted for soldering onto a solder pad disposed on the stem.

Preferably, the first and second dipoles include asymmetrically extended portions, the at least one isolation slot being formed between the asymmetrically extended portions.

There is further provided in accordance with another preferred embodiment of the present invention an antenna including a dual-polarized dipole pair, the dual-polarized dipole pair including a first dipole having a first polarization and a second dipole having a second polarization, a stem operative to support the dual-polarized dipole pair and including a feed arrangement for feeding the dual-polarized dipole pair, and an isolation element galvanically connected to the stem and not galvanically connected to the feed arrangement and to the dual-polarized dipole pair, the isolation element being operative to at least partially cancel mutual coupling between the first dipole and the second dipole.

Preferably, the isolation element includes a conductive strip.

Preferably, the conductive strip has a dimension of the order of $\lambda/2$, where $\lambda$ is an operating wavelength of the antenna. Alternatively, the conductive strip has a dimension of the order of $\lambda/4$, where $\lambda$ is an operating wavelength of the antenna.

Preferably, the stem includes a plurality of grooves and the conductive strip includes two recessed portions adapted for slotting into the plurality of grooves, each one of the recessed portions including a bent extrusion extending inwards from an edge thereof and adapted for soldering onto a solder pad disposed on the stem.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
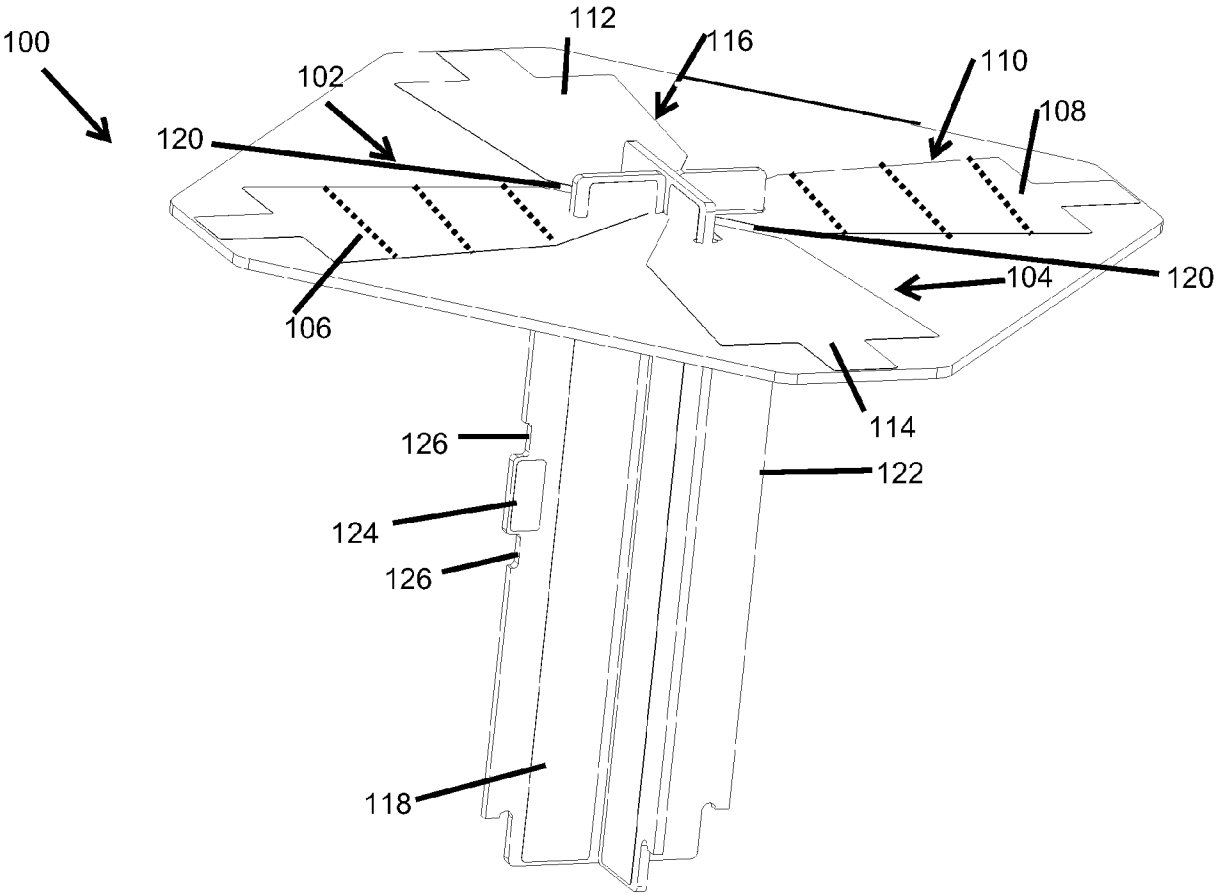
FIGS. 1A and 1B are simplified respective perspective and top view illustrations of an antenna constructed and operative in accordance with a preferred embodiment of the present invention.
Figure 1B:
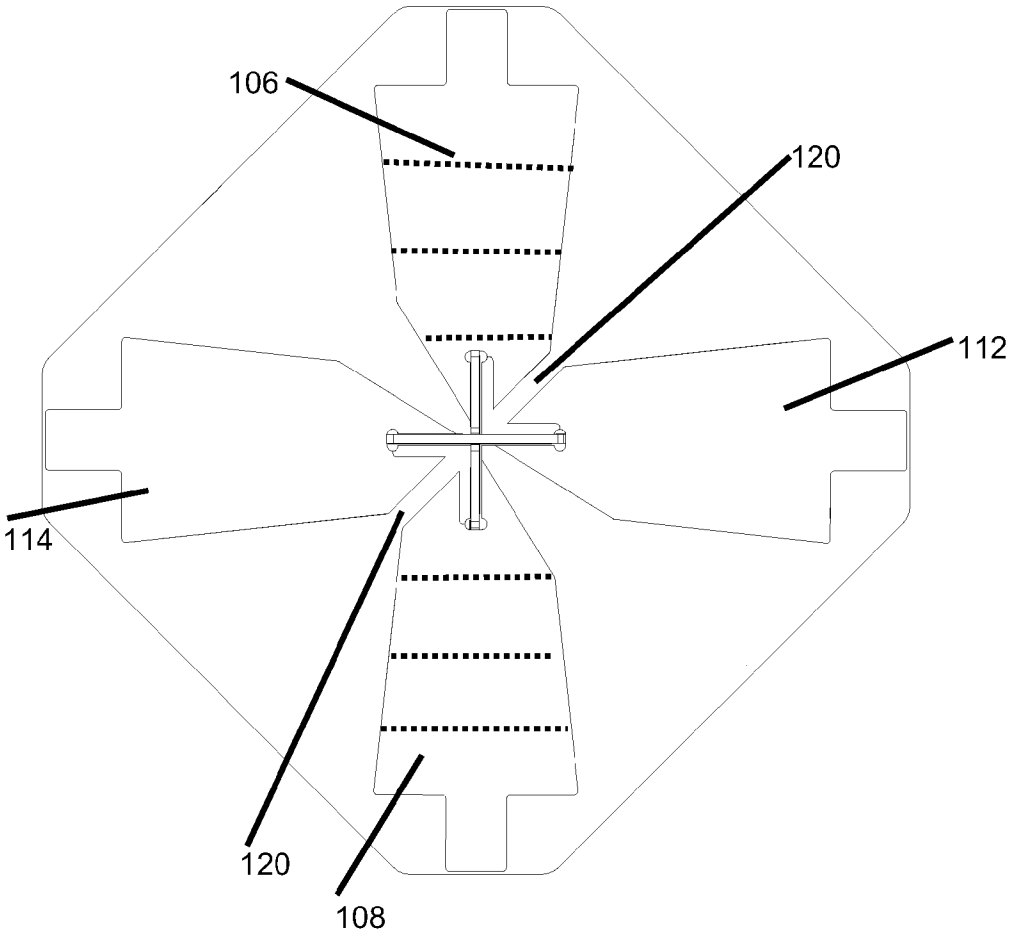

Reference is now made to FIGS. 1A and 1B, which are simplified respective perspective and top view illustrations of an antenna constructed and operative in accordance with a preferred embodiment of the present invention.

As seen in FIGS. 1A and 1B, there is provided an antenna 100. Antenna 100 preferably includes a first dipole 102 having a first polarization and a second dipole 104 having a second polarization. First dipole 102 preferably comprises a first dipole arm 106 and a second dipole arm 108, first and second dipole arms 106 and 108 constituting a first pair of dipole arms 110. Second dipole 104 preferably comprises a third dipole arm 112 and a fourth dipole arm 114, third and fourth dipole arms 112 and 114 constituting a second pair of dipole arms 116. It is appreciated that first dipole 102 is shown as shaded in FIGS. 1A and 1B for purpose of clarity of presentation only, in order to distinguish first dipole 102 from second dipole 104.

First pair of dipole arms 110 is preferably operative to radiate with a polarization of +45° and second pair of dipole arms 116 is preferably operative to radiate with a polarization of −45°. Antenna 100 is thus a dual-polarized antenna, preferably capable of radiating orthogonal ±45° polarized beams In operation of antenna 100, first dipole 102 and second dipole 104 are preferably fed dual-polarized radio-frequency (RF) signals by way of a feed arrangement, which feed arrangement preferably includes at least one balun, such as a balun 118 seen most clearly in FIG. 1A, and at least one microstrip feedline (not shown). It is appreciated, however, that the illustrated embodiment of balun 118 is exemplary only and that the feed arrangement may comprise any suitable feed arrangement known in the art for feeding first and second dipoles 102 and 104.

At least one dipole arm of the first pair of dipole arms 110 is preferably located with respect to at least one dipole arm of the second pair of dipole arms 116 so as to form an isolation slot 120 therebetween, as seen most clearly in FIG. 1B. Here, by way of example, isolation slot 120 is formed between first dipole arm 106 and third dipole arm 112 and between second dipole arm 108 and fourth dipole arm 114. Isolation slots 120 are preferably operative to improve the isolation between the first and second dipoles 102 and 104 by way of currents therealong at least partially cancelling mutual coupling between the first and second dipoles 102 and 104.

It will be appreciated that the presence of isolation slots 120 is particularly advantageous when antenna 100 is incorporated in an array, wherein, but for the provision of isolation slots 120, mutual coupling between multiple ones of first and second dipoles 102 and 104 would tend to significantly degrade the antenna performance.

It is a particularly advantageous feature of antenna 100 that the isolation between first and second dipoles 102 and 104 is improved by way of the formation of at least one isolation slot 120 between dipoles 102 and 104 without the addition of any external isolation elements to antenna 100. This is in contrast to conventional isolation solutions employed in dual-polarized antennas, which conventional isolation solutions typically comprise external elements distinct from the radiating structure of the antenna, such external elements occupying additional space and reducing mechanical stability and robustness of the antenna.

Antenna 100 further preferably includes a stem 122, which stem 122 is preferably operative to support first and second dipoles 102 and 104. The feed arrangement for antenna 100 is preferably integrally formed with stem 122, as seen in the case of balun 118 in FIG. 1A. Stem 122 may optionally include at least one solder pad, such as a solder pad 124, located between two grooves 126. Solder pad 124 and grooves 126 are optionally included in antenna 100 in order to facilitate the attachment thereto of additional isolation elements operative to further improve the isolation between first and second dipoles 102 and 104, as will be detailed henceforth with reference to FIGS. 3A and 3B.

It is appreciated that the particular configurations of stem 122 and of first, second, third and fourth dipole arms 106, 108, 112 and 114 are exemplary only and that first and second dipoles 102 and 104 may alternatively comprise dipole elements having a variety of different shapes, including asymmetrical shapes, as will be exemplified with reference to FIGS. 2A-3B below.

Figure 2A:
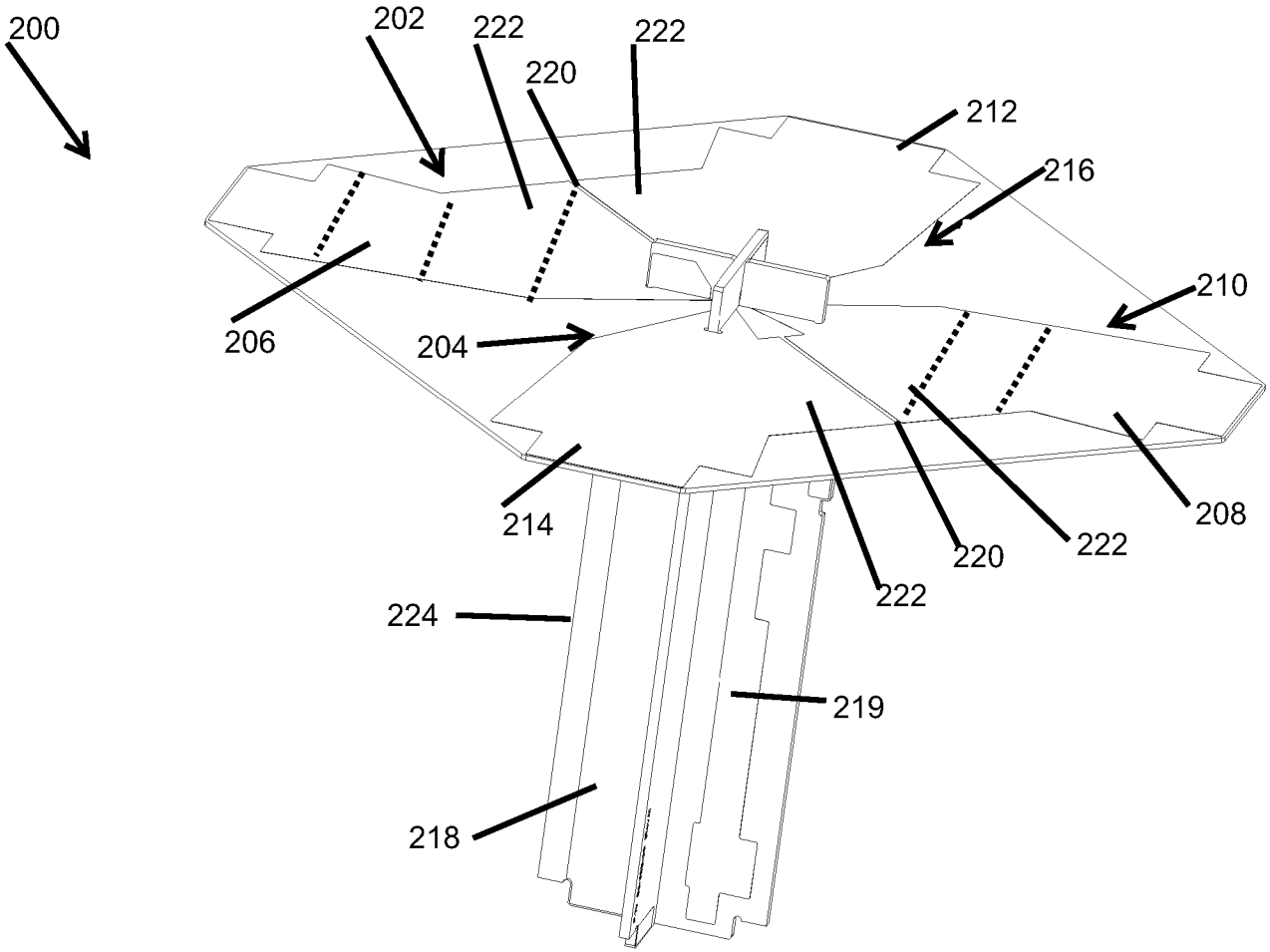
FIGS. 2A and 2B are simplified respective perspective and top view illustrations of an antenna constructed and operative in accordance with another preferred embodiment of the present invention.
Figure 2B:
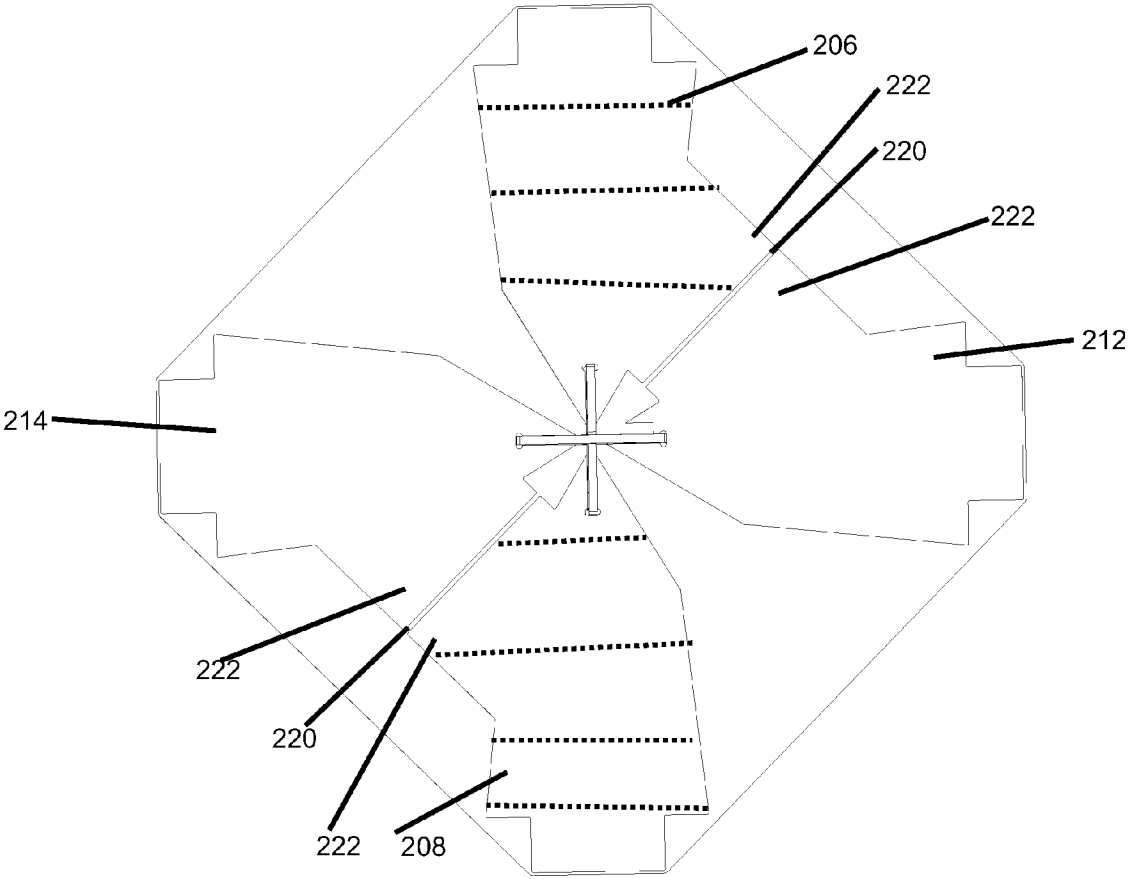

Reference is now made to FIGS. 2A and 2B, which are simplified respective perspective and top view illustrations of an antenna constructed and operative in accordance with another preferred embodiment of the present invention.

As seen in FIGS. 2A and 2B, there is provided an antenna 200. Antenna 200 preferably includes a first dipole 202 having a first polarization and a second dipole 204 having a second polarization. First dipole 202 preferably comprises a first dipole arm 206 and a second dipole arm 208, first and second dipole arms 206 and 208 constituting a first pair of dipole arms 210. Second dipole 204 preferably comprises a third dipole arm 212 and a fourth dipole arm 214, third and fourth dipole arms 212 and 214 constituting a second pair of dipole arms 216. It is appreciated that first dipole 202 is shown as shaded in FIGS. 2A and 2B for purpose of clarity of presentation only, in order to distinguish first dipole 202 from second dipole 204.

First pair of dipole arms 210 is preferably operative to radiate with a polarization of +45° and second pair of dipole arms 216 is preferably operative to radiate with a polarization of −45°. Antenna 200 is thus a dual-polarized antenna, preferably capable of radiating orthogonal ±45° polarized beams.

In operation of antenna 200, first dipole 202 and second dipole 204 are preferably fed dual-polarized RF signals by way of a feed arrangement, which feed arrangement preferably includes at least one balun, such as a balun 218, and at least one microstrip feed line, such as a microstrip feedline 219, seen most clearly in FIG. 2A. It is appreciated, however, that the illustrated embodiment of balun 218 and microstrip feedline 219 is exemplary only and that the feed arrangement may comprise any suitable feed arrangement known in the art for feeding first and second dipoles 202 and 204.

At least one dipole arm of the first pair of dipole arms 210 is preferably located with respect to at least one dipole arm of the second pair of dipole arms 216 so as to form an isolation slot 220 therebetween, as seen most clearly in FIG. 2B. Here, by way of example, isolation slot 220 is formed between first dipole arm 206 and third dipole arm 212 and between second dipole arm 208 and fourth dipole arm 214. Isolation slots 220 are preferably operative to improve the isolation between the first and second dipoles 202 and 204 by way of currents therealong at least partially cancelling mutual coupling between the first and second dipoles 202 and 204.

It is a particular feature of a preferred embodiment of the present invention that each one of first, second, third and fourth dipole arms 206, 208, 212 and 214 preferably includes an extended portion 222, between respective ones of which extended portions 222 isolation slots 220 are preferably formed. As seen most clearly in FIG. 2B, extended portions 222 are preferably provided on only a single side of each one of first, second, third and fourth dipole arms 206, 208, 212 and 214, such that each one of first, second, third and fourth dipole arms 206, 208, 212 and 214 is preferably asymmetrical.

It will be appreciated that the presence of isolation slots 220 is particularly advantageous when antenna 200 is incorporated in an array, wherein, but for the provision of isolation slots 220, mutual coupling between multiple ones of first and second dipoles 202 and 204 would tend to significantly degrade the antenna performance. Furthermore, the asymmetrical structure of first, second, third and fourth dipole arms 206, 208, 212 and 214 serves to advantageously rebalance the respective polarization patterns of first and second dipoles 202 and 204, which polarization patterns would otherwise be unbalanced due to mutual interference between first and second dipoles 202 and 204.

It is a particularly advantageous feature of antenna 200 that the isolation between first and second dipoles 202 and 204 is improved by way of the formation of at least one isolation slot 220 between dipoles 202 and 204, without the addition of any external isolation elements to antenna 200. This is in contrast to conventional isolation solutions employed in dual-polarized antennas, which conventional isolation solutions typically comprise external elements distinct from the radiating structure of the antenna, such external elements occupying additional space and reducing mechanical stability and robustness of the antenna.

Antenna 200 further preferably includes a stem 224, which stem 224 is preferably operative to support first and second dipoles 202 and 204. The feed arrangement for antenna 200 is preferably integrally formed with stem 224, as seen in the case of balun 218 and feedline 219 in FIG. 2A.

It is appreciated that the particular configurations of stem 224 and of first, second, third and fourth dipole arms 206, 208, 212 and 214 are exemplary only and that first and second dipoles 202 and 204 may alternatively comprise dipole elements having a variety of different shapes.

Figure 3A:
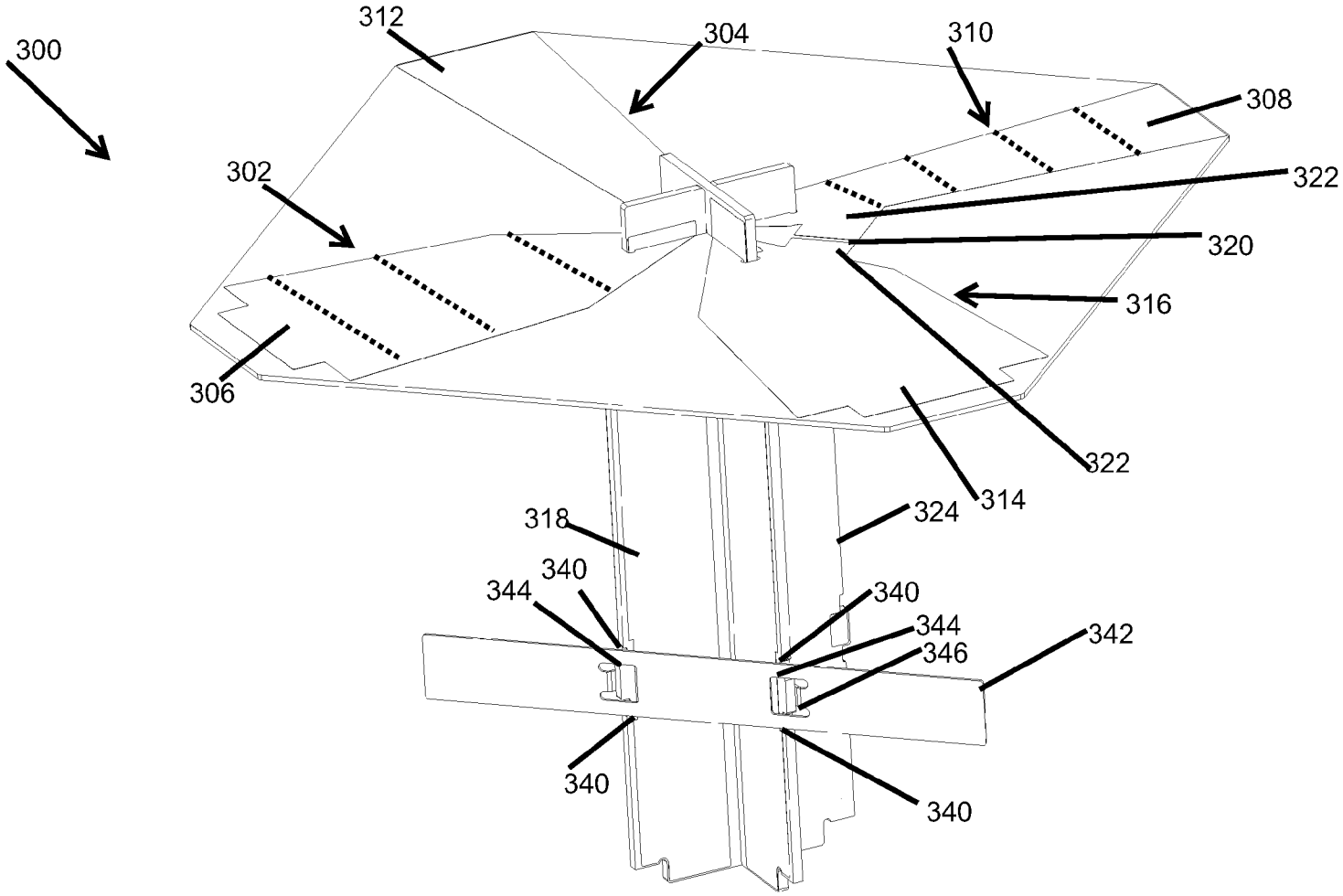
FIGS. 3A and 3B are simplified respective perspective and top view illustrations of an antenna constructed and operative in accordance with a further preferred embodiment of the present invention.
Figure 3B:
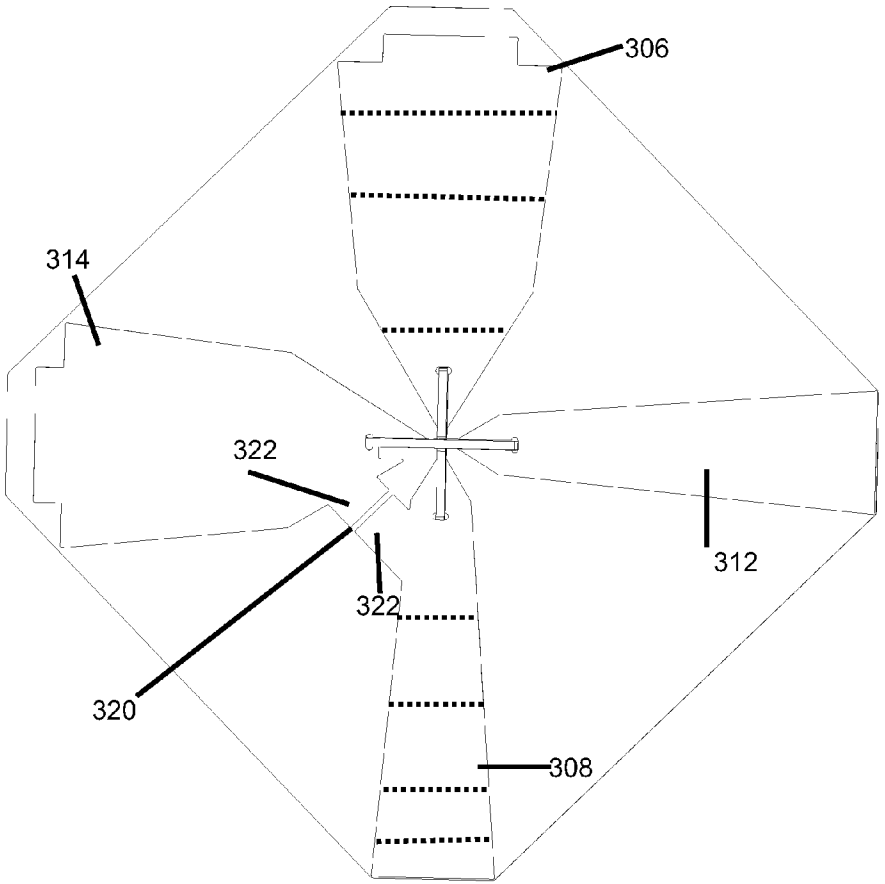

Reference is now made to FIGS. 3A and 3B, which are simplified respective perspective and top view illustrations of an antenna constructed and operative in accordance with a further preferred embodiment of the present invention.

As seen in FIGS. 3A and 3B, there is provided an antenna 300. Antenna 300 preferably includes a first dipole 302 having a first polarization and a second dipole 304 having a second polarization. First dipole 302 preferably comprises a first dipole arm 306 and a second dipole arm 308, first and second dipole arms 306 and 308 constituting a first pair of dipole arms 310. Second dipole 304 preferably comprises a third dipole arm 312 and a fourth dipole arm 314, third and fourth dipole arms 312 and 314 constituting a second pair of dipole arms 316. It is appreciated that first dipole 302 is shown as shaded in FIGS. 3A and 3B for purpose of clarity of presentation only, in order to distinguish first dipole 302 from second dipole 304.

First pair of dipole arms 310 is preferably operative to radiate with a polarization of +45° and second pair of dipole arms 316 is preferably operative to radiate with a polarization of −45°. Antenna 300 is thus a dual-polarized antenna, preferably capable of radiating orthogonal ±45° polarized beams In operation of antenna 300, first dipole 302 and second dipole 304 are preferably fed dual-polarized RF signals by way of a feed arrangement, which feed arrangement preferably includes at least one balun, such as a balun 318 seen most clearly in FIG. 3A and at least one microstrip feed line (not shown). It is appreciated, however, that the illustrated embodiment of balun 318 is exemplary only and that the feed arrangement may comprise any suitable feed arrangement known in the art for feeding first and second dipoles 302 and 304.

At least one dipole arm of the first pair of dipole arms 310 is preferably located with respect to at least one dipole arm of the second pair of dipole arms 316 so as to form an isolation slot 320 therebetween, as seen most clearly in FIG. 3B. Here, by way of example, one isolation slot 320 is formed between second dipole arm 308 and fourth dipole arm 314. Isolation slot 320 is preferably operative to improve the isolation between the first and second dipoles 302 and 304 by way of currents therealong at least partially cancelling mutual coupling between the first and second dipoles 302 and 304.

It is a particular feature of a preferred embodiment of the present invention that second dipole arm 308 and fourth dipole arm 314 each preferably includes an extended portion 322, between respective ones of which extended portions 322 isolation slot 320 is preferably formed. As seen most clearly in FIG. 3B, extended portions 322 are preferably provided on only a single side of second dipole arm 308 and fourth dipole arm 314, such that each one of second and fourth dipole arms 308 and 314 is preferably asymmetrical.

It will be appreciated that the presence of isolation slot 320 is particularly advantageous when antenna 300 is incorporated in an array, wherein, but for the provision of isolation slot 320, mutual coupling between multiple ones of first and second dipoles 302 and 304 would tend to significantly degrade the antenna performance. Furthermore, the asymmetrical structure of second and fourth dipole arms 308 and 314 serves to advantageously rebalance the respective polarization patterns of first and second dipoles 302 and 304, which polarization patterns would otherwise be unbalanced due to mutual interference between first and second dipoles 302 and 304.

It is a particularly advantageous feature of antenna 300 that the isolation between first and second dipoles 302 and 304 is improved by way of the formation of isolation slot 320 between dipoles 302 and 304 without the addition of any external isolation elements to antenna 300. This is in contrast to conventional isolation solutions employed in dual-polarized antennas, which conventional isolation solutions typically comprise external elements distinct from the radiating structure of the antenna, such external elements occupying additional space and reducing mechanical stability and robustness of the antenna.

Antenna 300 further preferably includes a stem 324, which stem 324 is preferably operative to support first and second dipoles 302 and 304. The feed arrangement for antenna 300 is preferably integrally formed with stem 324, as seen in the case of balun 318 in FIG. 3A.

Stem 324 preferably includes a plurality of grooves 340 preferably adapted for the insertion of an isolation element 342 therebetween. It is appreciated that grooves 340 may generally resemble grooves 126 shown in antenna 100. Isolation element 342 is preferably embodied as a planar conductive strip having a length of the order of $\lambda/4$, where $\lambda$ is an operating wavelength of antenna 300. It is appreciated, however, that the preferable length of isolation element 342 may be modified in accordance with the operating requirements of antenna 300. The presence of isolation element 342 further contributes to at least partially cancel mutual coupling between first dipole 302 and second dipole 304.

It is appreciated that isolation element 342 is preferably employed in antenna 300 in combination with the above-described dipole structure including isolation slot 320, in order to optimize isolation between first and second dipoles 302 and 304. However, isolation element 342 may alternatively be employed in any dual-polarized dipole radiating element benefitting from improved isolation between its ports, including antenna 100 and antenna 200.

Isolation element 342 preferably includes two recessed portions 344 preferably adapted for slotting into grooves 340. A bent extrusion 346 is preferably formed extending inwards from an edge of each recessed portion 344 and adapted for soldering onto a solder pad disposed on stem 324, such as solder pad 124 shown in FIG. 1A. It is appreciated that as a result of this mode of attachment of isolation element 342 to stem 324, isolation element 342 is galvanically connected to stem 324 but is not galvanically connected to the feed arrangement feeding first and second dipoles 302 and 304 or to first and second dipoles 302 and 304 themselves.

It is appreciated that the particular configurations of stem 324 and of first, second, third and fourth dipole arms 306, 308, 312 and 314 are exemplary only and that first and second dipoles 302 and 304 may alternatively comprise dipole elements having a variety of different shapes. It is further understood that although antenna 300 is shown to include only a single isolation element 342, antenna 300 may alternatively be adapted to include multiple ones of isolation element 342 in order to maximize isolation between first and second dipoles 302 and 304.

Figure 4:
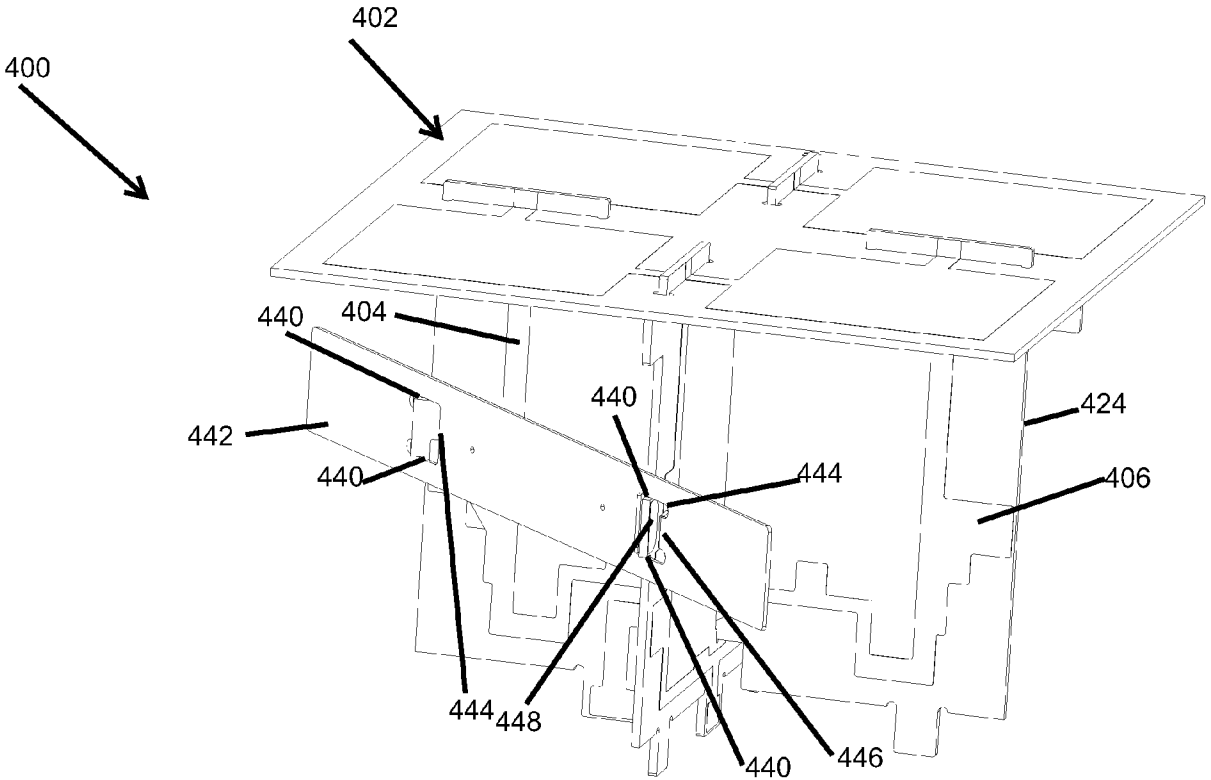
FIG. 4 is a simplified perspective view illustration of an antenna constructed and operative in accordance with yet another preferred embodiment of the present invention.

Reference is now made to FIG. 4, which is a simplified perspective illustration of an antenna constructed and operative in accordance with yet another preferred embodiment of the present invention.

As seen in FIG. 4, there is provided an antenna 400. Antenna 400 preferably includes a quartet of radiating patches 402 operative as a first pair of dipoles at a first polarization of +45° and as a second pair of dipoles at a second polarization of −45°. Antenna 400 thus constitutes a dual-polarized antenna, preferably capable of radiating orthogonal ±45° polarized beams In operation of antenna 400, quartet of radiating patches 402 is preferably fed dual-polarized RF signals by way of a feed arrangement, which feed arrangement preferably includes at least one balun (not shown) and at least one microstrip feed line, here embodied, by way of example, as a pair of microstrip feedlines 404 and 406. It is appreciated, however, that the illustrated embodiment of microstrip feedlines 404 and 406 is exemplary only and that the feed arrangement may comprise any suitable feed arrangement known in the art for feeding quartet of radiating patches 402.

Antenna 400 further preferably includes a stem 424, which stem 424 is preferably operative to support quartet of radiating patches 402. The feed arrangement for antenna 400 is preferably integrally formed with stem 424, as seen in the case of feedlines 404 and 406.

Stem 424 preferably includes a plurality of grooves 440 preferably adapted for the insertion of an isolation element 442 therebetween. It is appreciated that grooves 440 may generally resemble grooves 126 shown in antenna 100. Isolation element 442 is preferably embodied as a planar conductive strip having a length of the order of $\lambda/2$, where $\lambda$ is an operating wavelength of antenna 400. It is appreciated, however, that the preferable length of isolation element 442 may be modified in accordance with the operating requirements of antenna 400. Isolation element 442 is operative to at least partially cancel mutual coupling between the first and second pairs of dipoles formed by quartet of radiating patches 402.

Isolation element 442 preferably includes two recessed portions 444 preferably adapted for slotting into grooves 440. A bent extrusion 446 is preferably formed extending inwards from an edge of each recessed portion 444 and adapted for soldering onto a solder pad 448 disposed on stem 424. It is understood that in FIG. 4, isolation element 442 is shown as somewhat offset from solder pad 448 in order to more clearly present the structure and relative orientations of isolation element 442 and solder pad 448. In its assembled state, isolation element 442 is preferably directly soldered onto solder pad 448. It is appreciated that as a result of this mode of attachment of isolation element 442 to stem 424, isolation element 442 is galvanically connected to stem 424 but is not galvanically connected to the feed arrangement feeding quartet of radiating patches 402 or to the radiating patches themselves.

It is appreciated that the particular configurations of stem 424 and of quartet of radiating patches 402 are exemplary only and that quartet of radiating patches 402 may alternatively comprise dipole elements having a variety of different shapes. It is further understood that although antenna 400 is shown to include only a single isolation element 442, antenna 400 may alternatively be adapted to include multiple ones of isolation element 442 in order to maximize isolation between the respective radiating patches comprising quartet of radiating patches 402.

It will be appreciated by persons skilled in the art that the present invention is not limited by what has been particularly claimed hereinbelow. Rather, the scope of the invention includes various combinations and subcombinations of the features described hereinabove as well as modifications and variations thereof as would occur to persons skilled in the art upon reading the forgoing description with reference to the drawings and which are not in the prior art.

The invention claimed is:

1. An antenna comprising:

a first dipole having a first polarization, said first dipole comprising a first pair of dipole arms;

a second dipole having a second polarization, said second dipole comprising a second pair of dipole arms, wherein at least one dipole arm of said first pair of dipole arms is adjacent to at least one dipole arm of said second pair of dipole arms so as to form at least one isolation slot therebetween, and currents along said at least one isolation slot being operative to at least partially cancel mutual coupling between said first dipole and said second dipole;

a feed arrangement for feeding said first and second dipoles;

a nonconductive stem comprising multiple conjoined legs operative to support said first and second dipoles, said feed arrangement being integrally formed with said stem; and a conductive strip operative to further cancel mutual coupling between said first and second dipoles inserted between a plurality of grooves formed on adjacent legs of said stem, wherein said conductive strip is galvanically connected to solder pads on adjacent legs of said stem operative to secure said conductive strip to the stem, and said conductive strip is capacitively coupled to and not galvanically connected to said feed arrangement and to said first and second dipoles.

2. An antenna according to claim 1, wherein said feed arrangement comprises at least one feedline and at least one balun.

3. An antenna according to claim 1, wherein said conductive strip has a dimension of the order of $\lambda/4$, where $\lambda$ is an operating wavelength of said antenna.

4. An antenna according to claim 1, wherein said conductive strip comprises two recessed portions adapted for slotting into said plurality of grooves, each one of said recessed portions comprising a bent extrusion extending inwards from an edge thereof and adapted for soldering onto the solder pad disposed on said stem.

5. An antenna according to claim 1, wherein said first and second dipoles include at least one dipole arm having an asymmetrically extended portion, said at least one isolation slot being formed between said asymmetrically extended portions.

6. An antenna comprising:

a dual-polarized dipole pair, said dual-polarized dipole pair comprising a first dipole having a first polarization and a second dipole having a second polarization;

a nonconductive stem comprising multiple conjoined legs operative to support said dual-polarized dipole pair and comprising a feed arrangement for feeding said dual-polarized dipole pair; and a planer conductive isolation element galvanically connected to solder pads on adjacent legs of said stem operative to secure said conductive isolation element to said stem, and said conductive element is capacitively coupled to and not galvanically connected to said feed arrangement and to said dual-polarized dipole pair, said conductive isolation element being operative to at least partially cancel mutual coupling between said first dipole and said second dipole.

7. An antenna according to claim 6, wherein said conductive isolation element comprises a conductive strip.

8. An antenna according to claim 7, wherein said conductive strip has a dimension of the order of $\lambda/2$, where $\lambda$ is an operating wavelength of said antenna.

9. An antenna according to claim 7, wherein said conductive strip has a dimension of the order of $\lambda/4$, where $\lambda$ is an operating wavelength of said antenna.

10. An antenna according to claim 7, wherein said stem comprises a plurality of grooves and said conductive isolation element comprises two recessed portions adapted for slotting into said plurality of grooves, each one of said recessed portions comprising a bent extrusion extending inwards from an edge thereof and adapted for soldering onto the solder pad disposed on said stem.

11. An antenna according to claim 2, wherein said first and second dipoles include at least one dipole arm having an asymmetrically extended portion, said at least one isolation slot being formed between said asymmetrically extended portions.

12. An antenna according to claim 3, wherein said first and second dipoles include at least one dipole arm having an asymmetrically extended portion, said at least one isolation slot being formed between said asymmetrically extended portions.

* * * * *